US007302778B2

(12) United States Patent
MacMillan

(10) Patent No.: US 7,302,778 B2
(45) Date of Patent: Dec. 4, 2007

(54) CONSTRUCTION SUPPORT ASSEMBLY

(76) Inventor: James MacMillan, 72 Andrews Road, Conception Bay South (CA) A1X 4A3

( * ) Notice: Subject to any disclaimer, the term of this patent is extended or adjusted under 35 U.S.C. 154(b) by 258 days.

(21) Appl. No.: 10/789,971

(22) Filed: Mar. 1, 2004

(65) Prior Publication Data

US 2005/0246977 A1 Nov. 10, 2005

(51) Int. Cl.
*E02D 27/42* (2006.01)

(52) U.S. Cl. ..... 52/169.9; 52/298; 52/294; 52/295; 52/592.6

(58) Field of Classification Search ..... 52/169.9, 52/592.5, 592.6, 292–299
See application file for complete search history.

(56) References Cited

U.S. PATENT DOCUMENTS 1,020,645 A * 3/1912 Hall ..... 52/585.1
1,657,861 A * 1/1928 Lucas ..... 52/592.6
1,742,223 A 1/1930 Sears
2,550,945 A 5/1951 Steinhage et al.
2,826,393 A * 3/1958 Miller ..... 256/19
3,653,168 A * 4/1972 Cook ..... 52/294
4,186,540 A 2/1980 Mullins
4,918,891 A * 4/1990 Gerszewski ..... 52/295
5,205,097 A 4/1993 Harvey
5,226,276 A * 7/1993 Cahill ..... 52/592.6
5,560,171 A * 10/1996 McCoy ..... 52/592.6
5,647,185 A 7/1997 Forlini
5,934,035 A 8/1999 Rasmusen et al.
D437,366 S 2/2001 Stemmler
6,931,803 B1 * 8/2005 Davis et al. ..... 52/251

* cited by examiner

*Primary Examiner*—Jeanette E. Chapman

(57) ABSTRACT

A support assembly for receiving and maintaining one or more sections of an above-ground structure at a substantially upright position includes a base member having a protrusion connected thereto and extending upwardly therefrom in a substantially vertical direction. The support assembly further includes a plurality of ancillary members having top and bottom end portions defining engaging and receiving portions respectively. One of the ancillary members is positionable onto the base member and receives another ancillary member thereon. The assembly also includes a top member with a top end portion that has a slot formed therein and for receiving a section of an above-ground structure so that same can be maintained at a secure position.

3 Claims, 3 Drawing Sheets

CONSTRUCTION SUPPORT ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a construction assembly and, more particularly, to a construction support assembly including a plurality of stackable blocks.

2. Prior Art

In the past, if it was desired to build a pillar so as to, for example, support fence panels, gates or the like, and if it was desired that the pillar be of concrete construction, a construction crew was required to build the pillar in the same fashion as the crew would build any other vertical concrete structure, namely, using sauna tubes with concrete poured on-site to form a foundation base below frost lines. Such a process is time-consuming and cumbersome.

As a result, interlocking masonry construction block designs have been previously employed to overcome such a deficiency. Unfortunately, these systems generally exhibit a number of additional deficiencies. Typically, they employ an excessive amount of masonry material, e.g. concrete, which makes them rather heavy and expensive. Additionally, most interlocking blocks require very precise tolerances. Blocks that are not manufactured within such tolerances cannot be stacked securely and are unacceptable for use. Additionally, conventional block systems typically require the use of supplemental grout or fill to fasten adjacent blocks. None of the blocks which are currently known is suited for providing secure, slip-resistant support for manufactured fences and similar structures.

The commonly used cement blocks are erected in tiers or rows, which are most often offset, and the individual cement blocks are bonded together by mortar, which is interposed between the meeting horizontal and vertical surfaces of the blocks. The necessity of mortar bonding impairs the accuracy and speed with which such blocks can be erected, and requires a relatively high degree of skill to erect a properly aligned plurality of such blocks. The degree of skill needed to erect these mortar bonded prior art blocks, not to mention the laborious task, has all but relegated the laying of such blocks to skilled craftsmen. The laborious task of erecting the mortar bonded blocks and the high cost of employing skilled craftsmen has prompted the search for interlocking cement blocks, which would ease the labor and degree of skill needed to lay and properly align a plurality of such blocks.

Accordingly, a need remains for a construction support assembly to over come the above-mentioned shortcomings.

BRIEF SUMMARY OF THE INVENTION

In view of the foregoing background, it is therefore an object of the present invention to provide an assembly for supporting fences, decks and the like. These and other objects, features, and advantages of the present invention are provided by a support assembly for receiving and maintaining one or more sections of an above-ground structure at a substantially upright position. Such a support assembly is preferably formed from concrete but may also be formed from other suitable materials, well-known to a person of ordinary skill in the art of building construction.

The support assembly includes a base member that preferably has a substantially annular shape with a predetermined diameter, and a substantially planar top surface. Such a base member is positionable below a ground surface with the top surface disposed at a substantially horizontal position. The base member includes a protrusion connected to the top surface thereof and extends upwardly therefrom in a substantially vertical direction. Such a protrusion preferably has a conical shape for engaging a receiving portion of an ancillary member, described hereinbelow.

The present invention further includes a plurality of ancillary members that have a plurality of selectively engageable top and bottom end portions defining engaging and receiving portions, respectively, so that a height of the assembly can be adjusted as desired by a user. The plurality of engaging and receiving portions may have corresponding conical shapes respectively. Of course, such portions may be formed in various shapes without departing from the true scope of the invention. One of the plurality of ancillary members is advantageously positionable onto the base member and may preferably receive another one of the plurality of ancillary members thereon.

The assembly further includes a top member, which has an outer surface and a centrally disposed longitudinal axis, selectively engageable with the plurality of ancillary members and is spaced from the base member. The top member includes a top end portion that has a slot formed therein and for advantageously receiving a section of an above-ground structure so that same can be maintained at a secure position. The slot may have a substantially square first portion positioned about the axis and may further have a substantially rectangular portion integral with the first portion and extending outwardly therefrom towards the outer surface of the top member to thereby advantageously allow fluids to drain away from the slot.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
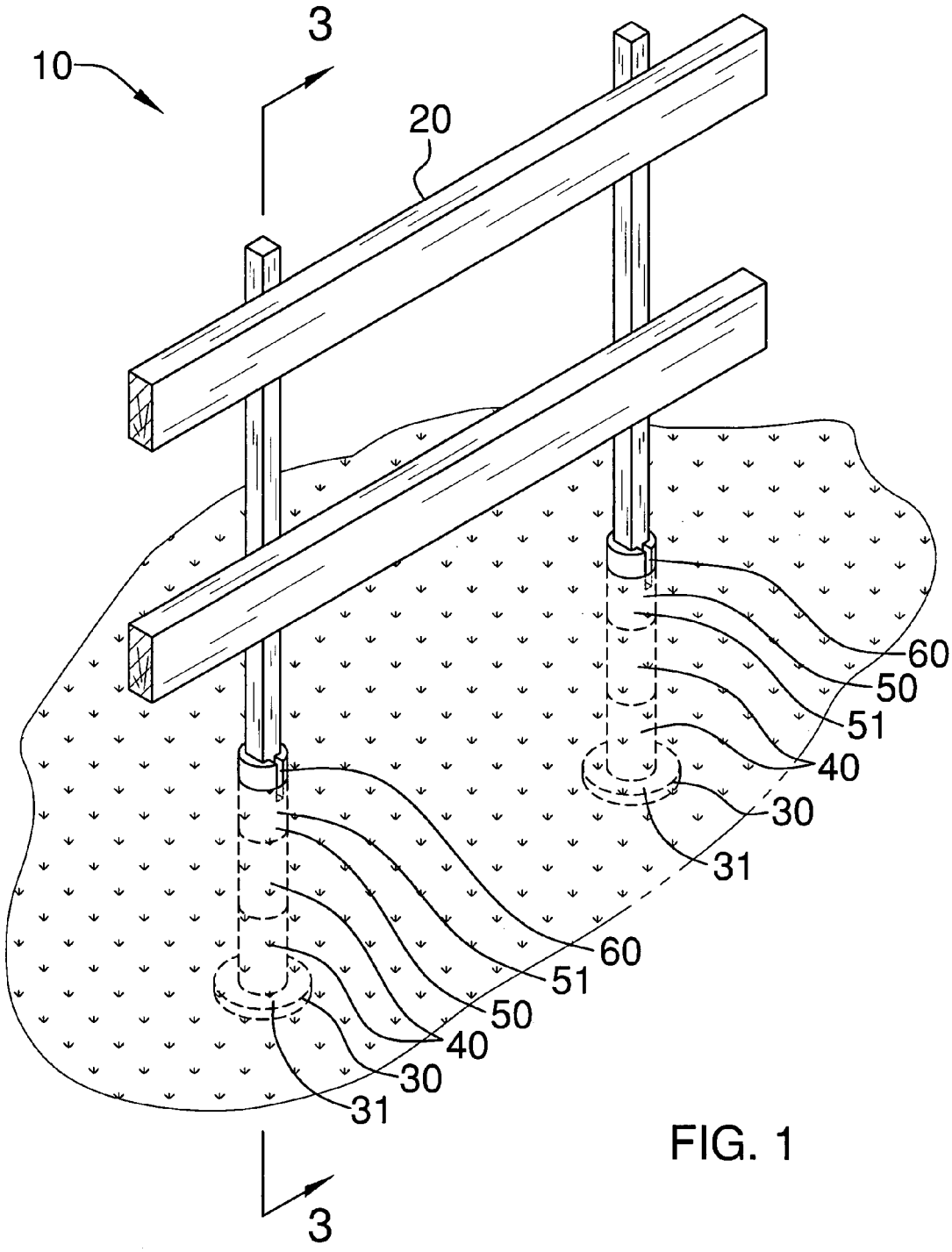
FIG. 1 is a perspective view showing a construction support assembly partially disposed beneath a ground surface and supporting a fence thereabove, in accordance with the present invention.
Figure 2:
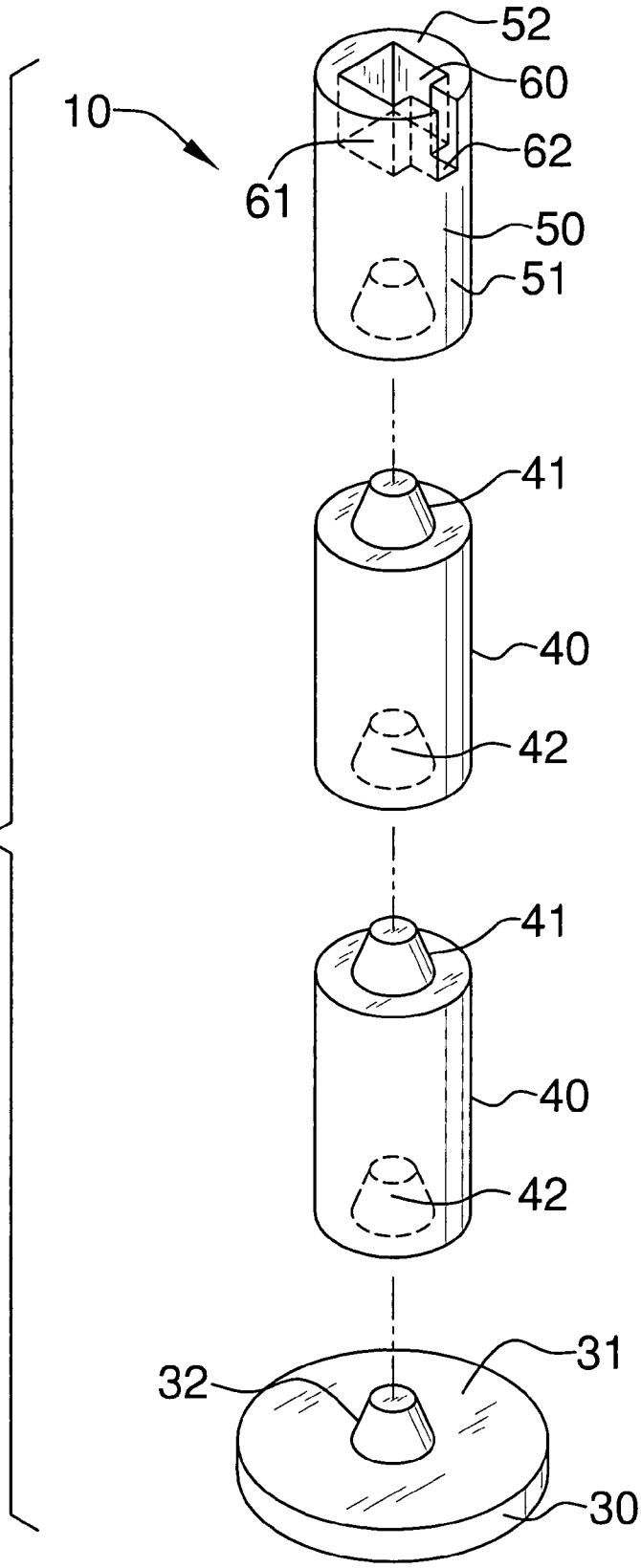
FIG. 2 is an enlarged perspective view of the assembly shown in FIG. 1.
Figure 3:
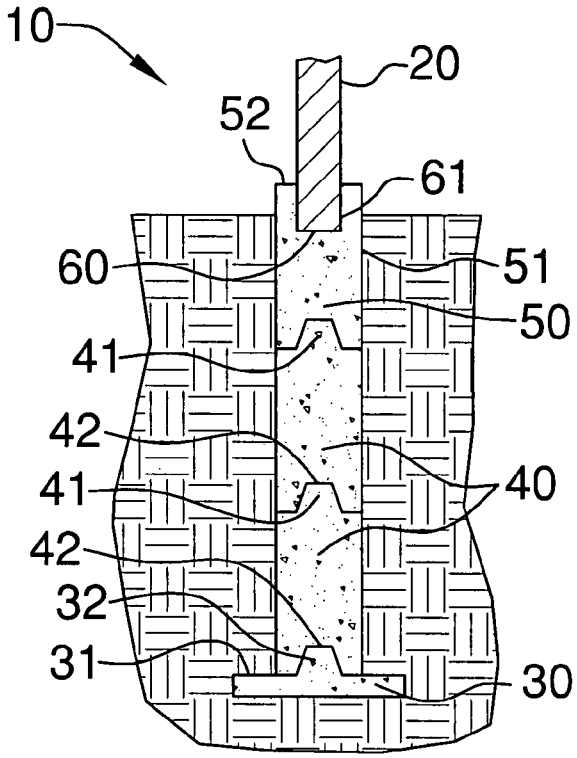
FIG. 3 is a cross-sectional view of the assembly shown in FIG. 1 supporting a fence.
Figure 4:
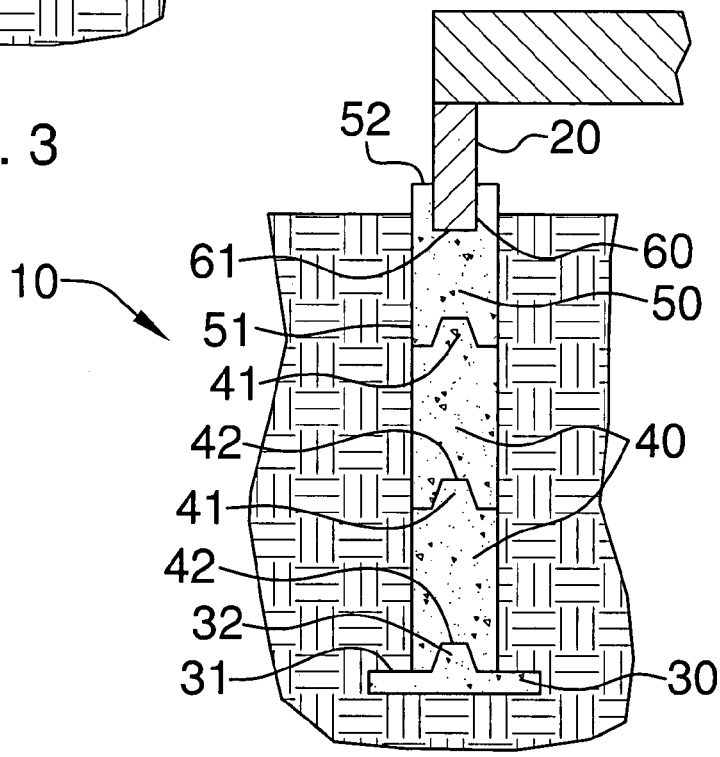
FIG. 4 is a cross-sectional view of the assembly shown in FIG. 1 supporting a deck.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide a construction support assembly. It should be understood that the assembly 10 may be used to support many different types of above-ground structures and should not be limited to only supporting fences or decks.

Referring initially to FIG. 1, the assembly 10 includes a support assembly 10 for receiving and maintaining one or more sections of an above-ground structure 20 at a substantially upright position. Such a support assembly 10 is formed from concrete but may also be formed from other suitable materials, well-known to a person of ordinary skill in the art of building construction.

The support assembly 10 includes a base member 30 that has a substantially annular shape with a predetermined diameter, and a substantially planar top surface 31. Such a base member 30 is positionable below a ground surface with the top surface 31 disposed at a substantially horizontal position. The base member 30 includes a protrusion 32 connected to the top surface 31 thereof and extends upwardly therefrom in a substantially vertical direction. Such a protrusion 32 has a conical shape for engaging a receiving portion 42 of an ancillary member 40, described hereinbelow.

The present invention further includes a plurality of ancillary members 40 that have a plurality of selectively engageable top 41 and bottom 42 end portions defining engaging 41 and receiving 42 portions, respectively, so that a height of the assembly 10 can be adjusted as desired by a user. The plurality of engaging 41 and receiving 42 portions have corresponding conical shapes respectively. Of course, such portions 41, 42 may be formed in various shapes without departing from the true scope of the invention. One of the plurality of ancillary members 40 is advantageously positionable onto the base member 30 and receives another one of the plurality of ancillary members 40 thereon.

The assembly further includes a top member 50, which has an outer surface 51 and a centrally disposed longitudinal axis, selectively engageable with the plurality of ancillary members 40 and is spaced from the base member 30. Because all the above mentioned members 30, 40, 50 are pre-cast, a worker will not have to wait several days for concrete, or other well-known materials, to cure. Advantageously, labor and material costs care significantly reduced. The top member 50 includes a top end portion 52 that has a slot 60 formed therein and for advantageously receiving a section of an above-ground structure 20 so that same can be maintained at a secure position.

The slot 60 has a substantially square first portion 61 positioned about the axis and further has a substantially rectangular portion 62 integral with the first portion 61 and extending outwardly therefrom towards the outer surface 51 of the top member 50 to thereby advantageously allow fluids to drain away from the slot 60 and prevent the above-ground structure 20 from sustaining damage, such as rotting.

The appealing features of the assembly 10 are its ease of use/installation, relatively lightweight, timesavings, and optimum size. Construction contractors, along with do-it-yourselfers, will find the new assembly quite useful and easy to install. Since there is no need to wait for concrete to cure, or for cement to dry, the work time would be cut in half, saving labor time and money.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A support assembly for receiving and maintaining one or more sections of an above-ground structure at a substantially upright position, said support assembly comprising:

a base member having an annular shape with a predetermined diameter and further having a substantially planar top surface, said base member being positioned below a ground surface with said top surface disposed at a substantially horizontal position, said base member including a centrally registered protrusion connected to said top surface and extending upwardly therefrom in a substantially vertical direction, said protrusion having a centrally registered bottom face directly coupled to said top surface of said base member, said protrusion further having an annular top face provided with a diameter smaller than a diameter of said bottom face respectively;

a plurality of ancillary members having a plurality of selectively engageable top and bottom end portions defining engaging and receiving portions respectively so that a height of said assembly can be adjusted as desired by a user, one said plurality of ancillary members being directly positioned onto said base member and for receiving another said plurality of ancillary members thereon, said plurality of engaging and receiving portions having corresponding conical shapes respectively, said engaging portions extending upwardly from a top surface of each of said ancillary members and being centrally registered with respective central longitudinal axes thereof; said receiving portions extending upwardly from a bottom surface of each of said ancillary members and being centrally registered with the central longitudinal axes thereof respectively, said receiving portions terminating subjacent to said engaging portions such that a major central region of each of said ancillary members defines a solid core formed from a rigid substance; and a top member selectively engageable with said plurality of ancillary members and being spaced from said base member, said top member including a top end portion having a slot formed therein and for receiving a section of an above-ground structure so that same can be maintained at a secure position;

wherein said top member has an outer surface and a centrally disposed longitudinal axis, said slot having a substantially square first portion positioned about the axis and further having a substantially rectangular portion integral with the first portion and extending outwardly therefrom towards said outer surface of said top member to thereby allow fluids to drain away from said slot, wherein said square first portion and said rectangular portion have respective longitudinal lengths greater than respective widths thereof such that the above-ground structure is effectively maintained at a substantially stable position and prohibited from disengaging said top member during inclement weather conditions.

2. A support assembly of claim 1, wherein said protrusion has a conical shape for engaging said receiving portion of said one ancillary member.

3. A support assembly of claim 1, wherein said base and top members and said plurality of ancillary members are formed from concrete.

* * * * *